US010818240B2

(12) United States Patent
Park

(10) Patent No.: US 10,818,240 B2
(45) Date of Patent: Oct. 27, 2020

(54) METHOD OF SENSING CHARACTERISTIC VALUE OF CIRCUIT ELEMENT AND DISPLAY DEVICE USING IT

(71) Applicant: LG Display Co., Ltd., Seoul (KR)

(72) Inventor: KwangMo Park, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/689,905

(22) Filed: Nov. 20, 2019

(65) Prior Publication Data

US 2020/0160789 A1 May 21, 2020

(30) Foreign Application Priority Data

Nov. 20, 2018 (KR) ..... 10-2018-0143135

(51) Int. Cl.

*G09G 3/3258* (2016.01)
*G09G 3/3266* (2016.01)
*G09G 3/3275* (2016.01)

(52) U.S. Cl.

CPC ..... *G09G 3/3258* (2013.01); *G09G 3/3266* (2013.01); *G09G 3/3275* (2013.01); *G09G 2300/043* (2013.01); *G09G 2300/0809* (2013.01); *G09G 2300/0819* (2013.01); *G09G 2310/08* (2013.01); *G09G 2320/0252* (2013.01); *G09G 2320/045* (2013.01); *G09G 2330/12* (2013.01)

(58) Field of Classification Search

CPC . G09G 3/3225–3258; G09G 2320/043; G09G 2320/045; G09G 2300/0819

See application file for complete search history.

(56) References Cited

U.S. PATENT DOCUMENTS

2017/0206836 A1* 7/2017 Kim ..... G09G 3/3233

* cited by examiner

*Primary Examiner* — Laurence J Lee
(74) *Attorney, Agent, or Firm* — Seed IP Law Group LLP

(57) ABSTRACT

A present disclosure relates to a method of sensing characteristic value of circuit element and display using it. The display device is able to accurately sense deterioration of the organic light-emitting diode disposed in each subpixel of a display panel and compensate for the deterioration. The method of sensing characteristic value of circuit element is able to save a sensing time for an entire display panel and improve a driving speed of the display device by efficiently performing a deterioration sensing process of the organic light-emitting diode.

14 Claims, 11 Drawing Sheets

METHOD OF SENSING CHARACTERISTIC VALUE OF CIRCUIT ELEMENT AND DISPLAY DEVICE USING IT

CROSS REFERENCE TO RELATED APPLICATION

This application claims priority to Korean Patent Application No. 10-2018-0143135, filed on Nov. 20, 2018, which is hereby incorporated by reference for all purposes as if fully set forth herein.

BACKGROUND

Technical Field

Exemplary embodiments relate to a method of sensing characteristic value of circuit element and display using it.

Description of the Related Art

With the development of the information society, there has been an increasing demand for a variety of types of image display devices. In this regard, a range of display devices, such as liquid crystal display (LCD) devices, plasma display devices, and organic light-emitting diode (OLED) display devices, have recently come into widespread use.

Among such display devices, organic light-emitting display devices have superior properties, such as rapid response speeds, high contrast ratios, high emissive efficiency, high luminance, and wide viewing angles, since self-emissive organic light-emitting diodes (OLEDs) are used.

Such an organic light-emitting display device may include organic light-emitting diodes disposed in a plurality of subpixels SP aligned in a display panel, and may control the organic light-emitting diodes to emit light by controlling a voltage flowing through the organic light-emitting diodes, so as to display an image while controlling luminance of the subpixels.

At this time, the organic light-emitting diodes included in each of the plurality of subpixels may deteriorate over time and may not accurately display the luminance to be represented through each of the subpixels due to such deterioration. Therefore, it is beneficial to measure the degree of deterioration of the organic light-emitting diodes included in each subpixel and compensate for the deterioration.

In this case, when the degree of deterioration of the organic light-emitting diode is sensed for each line of the subpixel, the sensing time of the entire display panel may be increased and the driving time of the OLED display device may be delayed by the time used for the sensing.

BRIEF SUMMARY

An aspect of the present disclosure provide a display panel and device able to accurately sense deterioration of the organic light-emitting diode disposed in each subpixel of a display panel and compensate for the deterioration.

Also another aspect of the present disclosure provide a method of sensing characteristic value of circuit element and display device using it, able to save a sensing time for an entire display panel and improve a driving speed of the display device by efficiently performing a deterioration sensing process of the organic light-emitting diode.

According one aspect, a display device may comprise a display panel including a plurality of gate lines, a plurality of data lines, and a plurality of subpixels, a gate driver circuit for driving the plurality of gate lines, a data driver circuit for driving the plurality of data lines, a deterioration sensing circuit electrically connected to the plurality of the subpixels for sensing deterioration of an organic light-emitting diode in the subpixel, and a timing controller for controlling signals applied to the gate driver circuit and the data driver circuit, wherein the timing controller controls the gate driver circuit to progress a first deterioration sensing process including an initializing period, a boosting period, and a sampling period with respect to an organic light-emitting diode in the subpixel connected to a first gate line, and to begin another initializing period of a second deterioration sensing process during the boosting period of the first deterioration sensing process with respect to another organic light-emitting diode in the subpixel connected to a second gate line.

The subpixel may include an organic light-emitting diode, a driving transistor driving the organic light-emitting diode and receiving a driving voltage-for-sensing deterioration, a switching transistor electrically connected between a gate node of the driving transistor and a data line among the plurality of data lines, and a sensing transistor electrically connected between a source node or a drain node of the driving transistor and a reference voltage line.

The deterioration sensing circuit may include an amplifier in which a non-inverting input terminal receives a reference voltage-for-sensing and an inverting input terminal is connected to a reference voltage line, a feedback capacitor electrically connected between the inverting input terminal and an output terminal of the amplifier, a reset switch connected to the feedback capacitor in parallel, and a sampling switch connected to the output terminal of the amplifier.

The deterioration sensing process with respect to an organic light-emitting diode may include an initializing period in which a high level scan signal is supplied to the gate line to charge a voltage for the deterioration sensing an organic light-emitting diode, a boosting period in which a parasitic capacitor of the organic light-emitting diode is charged by a current flowing through the organic light-emitting diode after the voltage charging for the deterioration sensing of the organic light-emitting diode is completed, and a sampling period in which a capacitance charged in the parasitic capacitor of the organic light-emitting diode is detected.

The deterioration sensing process with respect to an organic light-emitting diode may further include a reset period for resetting the deterioration sensing circuit after the sampling period.

A time interval between the first deterioration sensing process and the second deterioration sensing process may be larger than time duration of the reset period of the deterioration sensing circuit.

According to another aspect, provided is a method of sensing a characteristic value of a circuit element in a display device including a display panel comprised of a plurality of gate lines, a plurality of data lines, and a plurality of subpixels, a data driver circuit driving the plurality of data lines, a gate driver circuit driving the plurality of gate lines, a deterioration sensing circuit electrically connected to the plurality of the subpixels for sensing deterioration of an organic light-emitting diode in the subpixel, and a timing controller controlling signals applied to the gate driver circuit and the data driver circuit, the deterioration sensing circuit progresses a first deterioration sensing process including an initializing period, a boosting period, and a sampling period with respect to an organic light-emitting diode in the subpixel connected to a first gate line, and a second deterioration sensing process beginning another initializing period of the second deterioration sensing process during the boosting period of the first deterioration sensing process with respect to another organic light-emitting diode in the subpixel connected to a second gate line.

According to one or more embodiments, it is possible to effectively compensate a deterioration of an organic light-emitting diode by accurately sensing the change of capacitance charged from current through the organic light-emitting diode disposed in each subpixel through a deterioration sensing process of the organic light-emitting diode.

According to one or more embodiments, it is possible to save a sensing time for an entire display panel and improve a driving speed of the display device by proceeding a deterioration sensing process of the organic light-emitting diode in parallel by gate lines.

DESCRIPTION OF THE SEVERAL VIEWS OF THE DRAWINGS

The above and other objects, features, and advantages of the present disclosure will be more clearly understood from the following detailed description, taken in conjunction with the accompanying drawings, in which.

DETAILED DESCRIPTION

Figure 1:
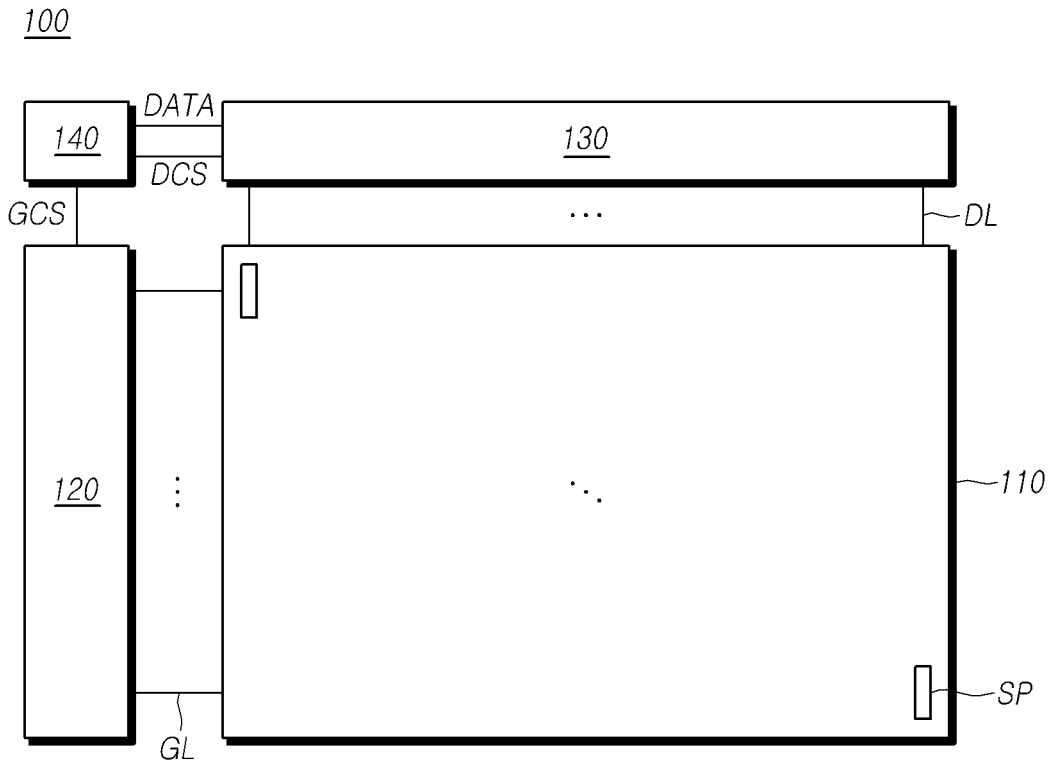
FIG. 1 illustrates a schematic diagram of a display device according to one or more embodiments.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in many different forms. Rather, these embodiments are provided so that the present disclosure will be thorough and complete, and will fully convey the scope of the present disclosure to a person having ordinary skill in the art.

The shapes, sizes, ratios, angles, numbers, and the like, inscribed in the drawings to illustrate exemplary embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated into the present disclosure will be omitted in the case that the subject matter of the present disclosure may be rendered unclear thereby. It will be understood that the terms "comprise," "include," "have," and any variations thereof used herein are intended to cover non-exclusive inclusions unless explicitly described to the contrary. Descriptions of components in the singular form used herein are intended to include descriptions of components in the plural form, unless explicitly described to the contrary.

In the analysis of components according to exemplary embodiments, it shall be understood that an error range is included therein, even in the case in which there is no explicit description thereof.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element. In the same context, it will be understood that when an element is referred to as being formed "on" or "under" another element, not only can it be directly located on or under the other element, but it can also be indirectly located on or under the other element via an intervening element.

In addition, terms, such as "first" and "second" may be used herein to describe a variety of components. It should be understood, however, that these components are not limited by these terms. These terms are merely used to discriminate one element or component from other elements or components. Thus, a first element referred to as first hereinafter may be a second element within the spirit of the present disclosure.

The features of one or more embodiments of the present disclosure may be partially or entirely coupled or combined with each other and may work in concert with each other or may operate in a variety of technical methods. In addition, respective one or more embodiments may be carried out independently or may be associated with and carried out in concert with other embodiments.

Hereinafter, the one or more embodiments will be described in detail with reference to the drawings.

FIG. 1 illustrates a schematic diagram of a display device according to one or more embodiments.

Referring to FIG. 1, the display device 100 according to one or more embodiments may include a display panel 110 in which a plurality of subpixels SP are aligned in rows and columns, a gate driver circuit 120 and a data driver circuit 130 for driving the display panel 110, and a timing controller 140 for controlling the gate driver circuit 120 and the data driver circuit 130.

In the display panel 110, a plurality of gate lines GL and a plurality of data lines DL are disposed, and a plurality of subpixels SP are aligned in adjacent areas in which the plurality of gate lines GL overlap the plurality of data lines DL. For example, in a display device having a resolution of 2,160×3,840, that is, 2,160 gate lines GL and 3,840 data lines DL may be provided, and plurality of subpixels SP may be aligned in adjacent areas in which the plurality of gate lines GL overlap the plurality of data lines DL.

The gate driver circuit 120 is controlled by the timing controller 140, and controls the driving timing of the plurality of subpixels SP by sequentially supplying scan signals SCAN to the plurality of gate lines GL disposed in the display panel 110. In the display device 100 having a resolution of 2,160×3,840, sequentially supplying the scan signals to the 2,160 gate lines GL from the first gate line GL1 to the 2,160th gate line GL may be referred to as 2,160-phase driving. Otherwise, sequentially supplying the scan signals to every four gate lines, as in a case in which the scan signals are supplied sequentially from first gate line GL1 to fourth gate lines GL4, and then are supplied sequentially from fifth gate line GL5 to eighth gate line GL8, is referred to as 4-phase driving. As described above, a case in which the scan signals are supplied sequentially to every N number of gate lines may be referred as N-phase driving.

The gate driver circuit 120 may include one or more gate driver integrated circuits (GDIC), which may be disposed on one side or both sides of the display panel 110 depending on the driving method. Alternatively, the gate driver circuit 120 may be implemented in a gate-in-panel (GIP) structure embedded in a bezel area of the display panel 110.

The data driver circuit 130 receives image data DATA from the timing controller 140, and converts the received image data into an analog data voltage Vdata. Afterwards, the data driver circuit 130 supplies the data voltage Vdata to each of the data lines DL at points in time at which the scan signal is applied through the gate lines GL, so that each of the subpixels SP connected to the data lines DL is emitted with a corresponding luminance in response to the data voltage Vdata.

Likewise, the data driver circuit 130 may include one or more source driver integrated circuits (SDICs). Each of the source driver Integrated circuits SDICs may be connected to a bonding pad of the display panel 110 by a tape automated bonding (TAB) or a chip on glass (COG), or may be directly mounted on the display panel 110. In some cases, each of the source driver integrated circuits SDIC may be integrated with the display panel 110. In addition, each of the source driver integrated circuits SDICs may be implemented with a chip on film (COF) structure. In this case, the source driver integrated circuit SDIC may be mounted on circuit films to be electrically connected to the data lines DL in the display panel 110 via the circuit films.

The timing controller 140 supplies various control signals to the gate driver circuit 120 and the data driver circuit 130, and controls the operations of the gate driver circuit 120 and the data driver circuit 130. That is, the timing controller 140 controls the gate driver circuit 120 to supply the scan signal SCAN in response to a time realized by respective frames, and on the other hand, converts data input from an external source into image data having a data signal format readable by the data driver circuit 130, and supplies the converted image data to the data driver circuit 130.

Here, the timing controller 140 receives various timing signals, including a vertical synchronization signal Vsync, a horizontal synchronization signal Hsync, a data enable signal DE, a clock signal CLK, and the like, from an external source (e.g., a host system). Accordingly, the timing controller 140 generates control signals using the various timing signals received from the external source, and supplies the control signals to the gate driver circuit 120 and the data driver circuit 130.

For example, the timing controller 140 supplies various gate control signals, including a gate start pulse GSP, a gate shift clock GSC, a gate output enable GOE, and the like, to control the gate driver circuit 120. Here, the gate start pulse GSP is used to control the start timing of one or more gate driver integrated circuits GDICs of the gate driver circuit 120. In addition, the gate shift clock GSC is a clock signal commonly supplied to the one or more gate driver integrated circuits GDICs to control the shift timing of the scan signal. The gate output enable GOE designates timing information of the one or more gate driver integrated circuits GDICs.

In addition, the timing controller 140 supplies various data control signals DCSs, including a source start pulse SSP signal, a source sampling clock SSC, a source output enable SOE, and the like, to control the data driver circuit 130. Here, the source start pulse SSP is used to control the start timing for the data sampling of one or more source driver integrated circuits SDICs of the data driver circuit 130. The source sampling clock SSC is a clock signal controlling the sampling timing of data in each of the source driver integrated circuits SDICs. The source output enable SOE controls the output timing of the data driver circuit 130.

The display device 100 may further include a power management integrated circuits PMIC supplying various forms of voltage or current to the display panel 110, the gate driver circuit 120, the data driver circuit 130, and the like, or controlling various forms of voltage or current to be supplied to the same.

The subpixels SP are located adjacent to points at which the gate lines GL overlap with the data lines DL, and a light-emitting element may be disposed in each of the subpixels SP. For example, the organic light-emitting display device 100 includes a light-emitting element, such as a light-emitting diode (LED) or an organic light-emitting diode (OLED) in each of the subpixels SP, and may display an image by controlling current flowing through the light-emitting elements in response to the data voltage Vdata.

Figure 2:
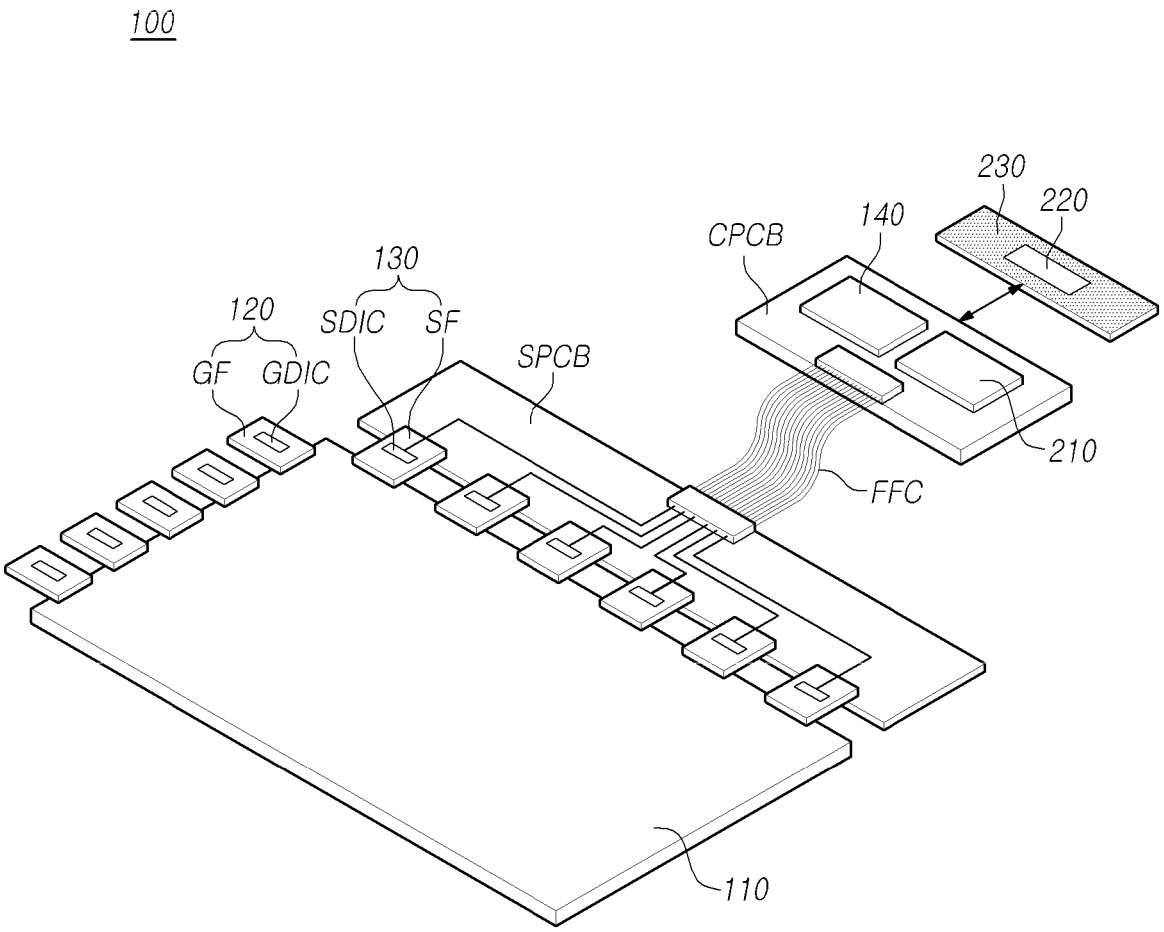
FIG. 2 illustrates a system of the display device according to one or more embodiments.

FIG. 2 illustrates a system of the display device according to one or more embodiments.

In the display device 100 illustrated in FIG. 2, each of the source driver integrated circuits SDICs of the data driver circuit 130 is implemented with a COF among various structures, such as a TAB, a COG, and a COF, and the gate driver circuit 120 is implemented with a GIP among various structures, such as a TAB, a COG, a COF, and a GIP.

The plurality of source driver integrated circuits SDICs of the data driver circuit 130 may be mounted on a source-side circuit films SF, respectively. One portion of the source-side circuit film SF may be electrically connected to the display panel 110. In addition, electrical lines may be disposed in the top portion of the source-side circuit films SF to electrically connect the source driver integrated circuits SDICs and the display panel 110.

The display device 100 may include at least one source printed circuit board SPCB in order to connect the plurality of source driver integrated circuits SDICs to other devices by electrical circuit, and a control printed circuit board CPCB in order to mount various control components and electric devices.

The other portion of the source-side circuit film SF, on which the source driver integrated circuit SDIC is mounted, may be connected to the at least one source printed circuit board SPCB. That is, one portion of source-side circuit film SF, on which the source driver integrated circuit SDIC is mounted, may be electrically connected to the display panel 110, and the other portion of the source-side circuit film SF may be electrically connected to the source printed circuit board SPCB.

The timing controller 140 and a power management integrated circuit PMIC 210 may be mounted on the control printed circuit board CPCB. The timing controller 140 may control the operations of the data driver circuit 130 and the gate driver circuit 120. The power management integrated circuit PMIC 210 may supply various forms of voltage or current including a driving voltage, to the data driver circuit 130, the gate driver circuit 120, and the like, or may control the voltage or current to be supplied to the same.

At least one source printed circuit board SPCB and the control printed circuit board CPCB may have circuitry connection by at least one connecting member. The connecting member may be, for example, a flexible printed circuit FPC, a flexible flat cable FFC, or the like. At least one source printed circuit board SPCB and the control printed circuit board CPCB may be integrated into a single printed circuit board.

The display device 100 may further include a set board 230 electrically connected to the control printed circuit board CPCB. The set board 230 may also be referred to as a power board. A main power management circuit M-PMC 220 managing overall power of the display device 100 may be located on the set board 230. The main power management circuit M-PMC 220 may be coupled to the power management integrated circuit PMIC 210.

In the display device 100 having the above-described configuration, a driving voltage EVDD is generated by the set board 230 to be transferred to the power management integrated circuit 210. The power management integrated circuit 210 transfers the driving voltage EVDD, which is used during an image driving period or a sensing period, to the source printed circuit board SPCB through a flexible printed circuit FPC or a flexible flat cable FFC. The driving voltage EVDD, transferred to the source printed circuit board SPCB, is supplied to emit or sense a specific subpixel SP in the display panel 110 via the source driver integrated circuits SDICs.

Each of the subpixels SP aligned in the display panel 110 of the display device 100 may include a light-emitting element, such as an organic light-emitting diode (OLED), and circuit elements, such as a driving transistor to drive it.

The type and number of circuit elements forming each of the subpixels SP may be variously determined depending on the function, the design, or the like.

Figure 3:
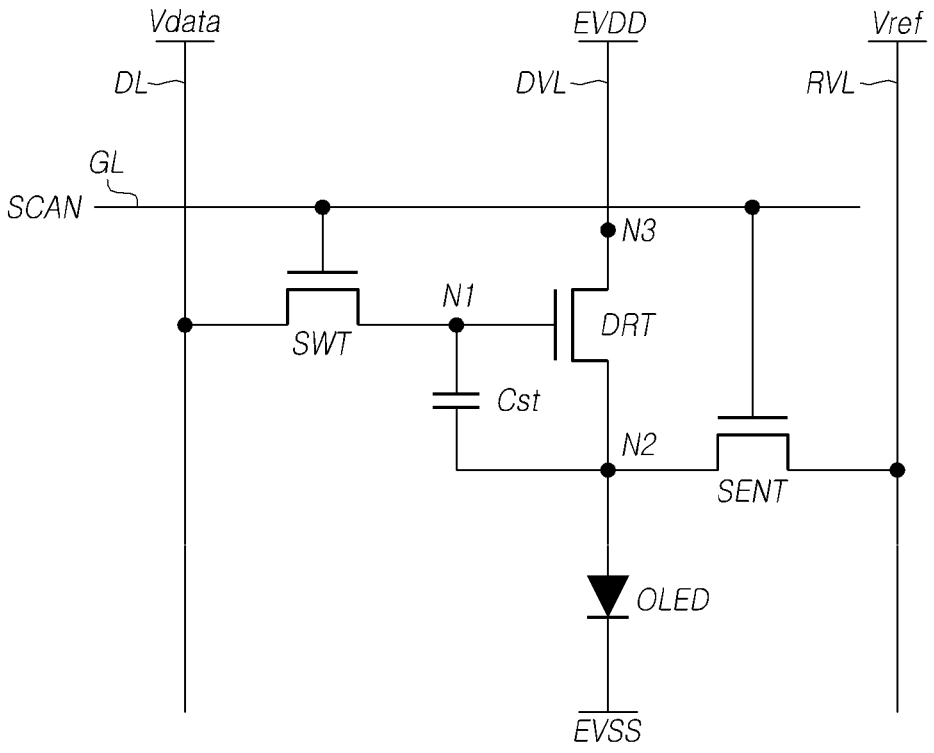
FIG. 3 illustrates a circuit structure of subpixels aligned in the display device according to one or more embodiments.

FIG. 3 illustrates a circuit structure of subpixels aligned in the display device according to one or more embodiments.

Referring to FIG. 3, each of the subpixels SP aligned in the display device 100 according to one or more embodiments may include one or more transistors, capacitor, and an organic light-emitting diode OLED as a light-emitting element.

For example, the subpixel SP may include a driving transistor DRT, a switching transistor SWT, a sensing transistor SENT, a storage capacitor Cst, and the organic light-emitting diode OLED.

The driving transistor DRT may have a first node N1, a second node N2, and a third node N3. The first node N1 of the driving transistor DRT may be a gate node to supply a data voltage Vdata through a data line DL when the switching transistor SWT is turned on. The second node N2 of the driving transistor DRT may be electrically connected to an anode of the organic light-emitting diode OLED, and may be a drain node or a source node. The third node N3 of the driving transistor DRT may be electrically connected to a driving voltage line DVL in which a driving voltage EVDD is supplied, and may be a drain node or a source node.

Here, the driving voltage EVDD for the image driving may be supplied to the driving voltage line DVL in the image driving period. For example, the driving voltage EVDD for the image driving may be about 27 V.

The switching transistor SWT is electrically connected between the first node N1 of the driving transistor DRT and the data line DL, and operates in response to the scan signal SCAN supplied thereto through the gate line GL connected to the gate node. In addition, it controls the operation of the driving transistor DRT by supplying the data voltage Vdata from the data line DL to the gate node of the driving transistor DRT when the switching transistor SWT is turned on.

The sensing transistor SENT is electrically connected between the second node of the driving transistor DRT and a reference voltage line RVL, and operates in response to the scan signal SCAN supplied thereto through the gate line GL connected to the gate node. When the sensing transistor SENT is turned on, a reference voltage-for-sensing Vref from the reference voltage line RVL is supplied to the second node N2 of the driving transistor DRT.

That is, the voltages of the first node N1 and the second node N2 of the driving transistor DRT may be controlled by controlling the switching transistor SWT and the sensing transistor SENT. Consequently, a current for driving the organic light-emitting diode OLED can be supplied.

The switching transistor SWT and the sensing transistor SENT may be connected to a single gate line GL or to different signal lines. In here, it illustrates an exemplary structure of which the switching transistor SWT and the sensing transistor SENT are connected to a single gate line GL. In this case, the switching transistor SWT and the sensing transistor SENT are controlled simultaneously by the scan signal SCAN from the single gate line GL, and thus the aperture ratio of the subpixels SP may be improved.

In addition, the transistors disposed in the subpixels SP may be not only n-type transistors, but also p-type transistors. Herein, it illustrates the exemplary structure of the n-type transistors.

The storage capacitor Cst is electrically connected between the first node N1 and the second node N2 of the driving transistor DRT, and serves to maintain the data voltage Vdata for one frame period.

Such a storage capacitor Cst may be connected between the first node N1 and the third node N3 of the driving transistor DRT depending on the type of the driving transistor DRT. The anode of the organic light-emitting diode OLED may be electrically connected to the second node N2 of the driving transistor DRT, and a base voltage EVSS may be supplied to a cathode of the organic light-emitting diode OLED. Here, the base voltage EVSS may be the ground voltage or a voltage higher or lower than the ground voltage. In addition, the base voltage EVSS may vary depending on the driving condition. For example, the base voltage EVSS during the image driving period may be different from the base voltage EVSS during the sensing period.

Figure 4:
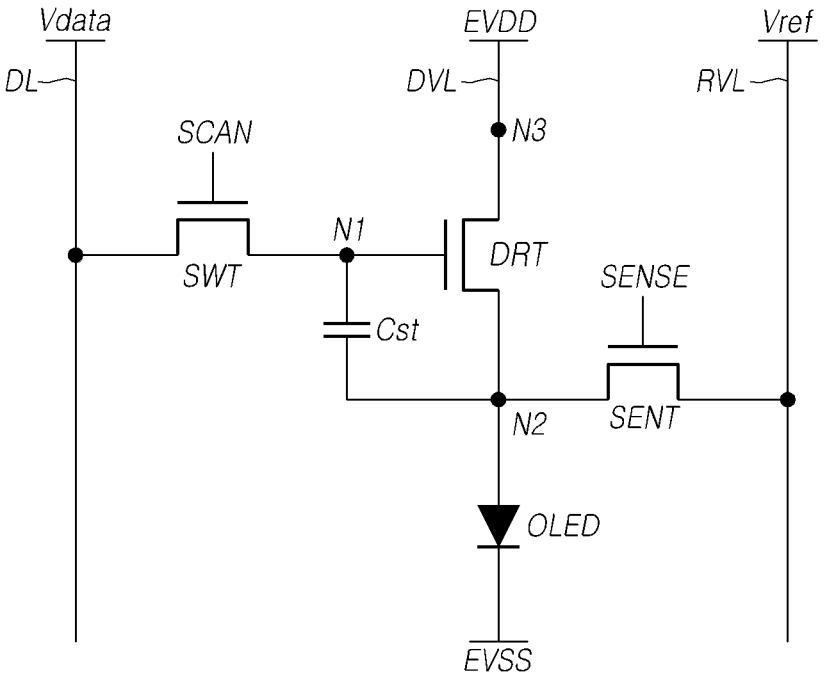
FIG. 4 illustrates a circuit structure of subpixels in which a switching transistor SWT and a sensing transistor SENT are connected to different signal lines in the display device according to one or more embodiments.

FIG. 4 illustrates a circuit structure of subpixels in which a switching transistor SWT and a sensing transistor SENT are connected to different signal lines in the display device according to one or more embodiments.

Referring to FIG. 4, in the display device 100 according to one or more embodiments, the switching transistor SWT may be controlled to be turned on and turned off by receiving a scan signal SCAN through a corresponding gate line GL at a gate node, and the transistor SENT may be controlled to be turned on and turned off by receiving a sense signal SENSE different from the scan signal SCAN through the corresponding gate line GL at a gate node.

When the signals for controlling the switching transistor SWT and the sensing transistor SENT are different by the scan signal SCAN and the sense signal SENSE, the switching transistor SWT and the sensing transistor SENT may be controlled independently. However, the aperture ratio of the subpixel SP may be lowered.

The structures of the subpixel SP as described in FIG. 3 and FIG. 4 have a three transistors and one capacitor 3T1C. However, this is merely for illustrative purposes, and one or more transistors, or in some cases, one or more capacitors may be further included. In addition, the plurality of subpixels SP may have the same structure, or some of the plurality of subpixels SP may have a different structure from the other subpixels.

The organic light-emitting diode OLED emits light according to the current supplied by the operation of the driving transistor DRT, and the corresponding subpixel SP may display luminance corresponding to the data voltage Vdata.

In here, the organic light-emitting diode (OLED) may deteriorate over time. When the organic light-emitting diode (OLED) deteriorates, the organic light-emitting diode OLED may not display desired luminance corresponding to the data voltage Vdata supplied to the subpixel SP. In addition, since the degree of deterioration of the organic light-emitting diodes OLED included in each subpixel SP may be different from each other, a luminance deviation may occur. This may further negatively impact user experience by failing to provide consistent luminosity during the use of the display device.

Therefore, the display device 100 according to the one or more embodiments enables to sense and compensate for deterioration of the subpixel SP. In order to sense deterioration of the subpixel SP, a data voltage Vdata for sensing may be supplied to the subpixel SP in a deterioration sensing period of the organic light emitting diode OLED so that a current flows to the organic light-emitting diode OLED, and a change of capacitance charged in a parasitic capacitor Coled of the organic light-emitting diode OLED may be detected. For example, the deterioration or the degradation of an OLED may be determined based on the changes in the amount of parasitic capacitance charged in the parasitic capacitor of the OLED.

In this process, it may use a method for measuring a current flowing by voltage charged in the parasitic capacitor Coled by supplying a driving voltage in a deterioration sensing period of the organic light-emitting diode OLED shorter than an image driving period in order to sense effectively for the deterioration of the organic light-emitting diode OLED. Such a method may also be referred to as current sensing.

Figure 5:
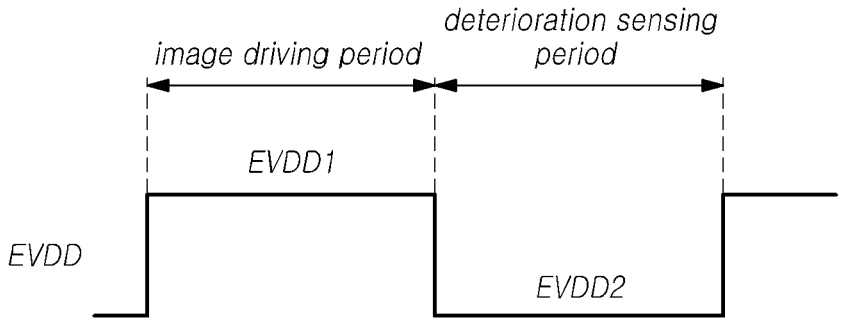
FIG. 5 illustrates a driving voltage applied to a display panel during an image driving period and a deterioration sensing period in the display device according to one or more embodiments.

FIG. 5 illustrates a driving voltage applied to a display panel during an image driving period and a deterioration sensing period in the display device according to one or more embodiments.

Referring to FIG. 5, in case of the display device 100 according to one or more embodiments, the image driving voltage EVDD1 applied to the display panel 110 during the image driving period may be different from the driving voltage-for-sensing deterioration EVDD2 applied to the display panel 110 for sensing a organic light-emitting diode OLED during a deterioration sensing period. The driving voltage-for-sensing deterioration EVDD2 is applied at a level lower than the image driving voltage EVDD1 so that the degree of deterioration of the organic light-emitting diode OLED may be accurately sensed.

The image driving voltage EVDD1 and the driving voltage-for-sensing deterioration EVDD2 may be different depending on the product configuration or model of the display device 100. For example, the image driving voltage EVDD1 may be about 27V, and the driving voltage-for-sensing deterioration EVDD2 may be about 10V.

Figure 6:
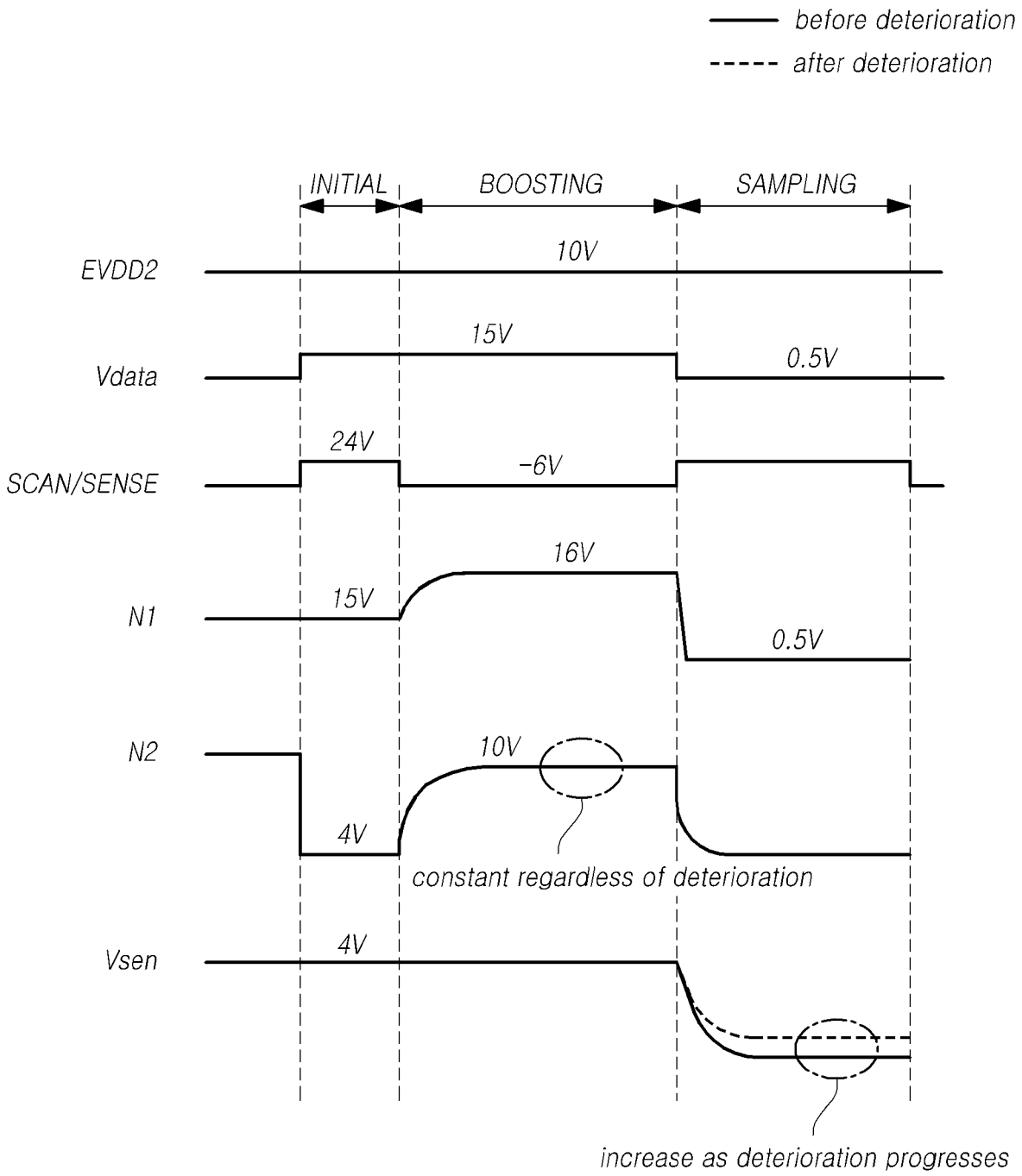
FIG. 6 illustrates a signal timing diagram for sensing deterioration of a subpixel using driving voltage-for-sensing deterioration in the display device according to one or more embodiments.

FIG. 6 illustrates a signal timing diagram for sensing deterioration of a subpixel using driving voltage-for-sensing deterioration in the display device according to one or more embodiments.

Referring to FIG. 6, a deterioration sensing period for the organic light-emitting diode OLED in the display device 100 according to the one or more embodiments may include an initializing period INITIAL, a boosting period BOOSTING, a sampling period SAMPLING, and a recovery period.

The initializing period INITIAL is a period to charge a voltage for deterioration sensing of the organic light-emitting diode OLED, and a high level scan signal (for example, about 24 V) may be applied to the gate line GL in the initializing period INITIAL.

The boosting period BOOSTING is a period in which a parasitic capacitor Coled of the organic light-emitting diode OLED is charged by a current flowing through the organic light-emitting diode OLED after the voltage charging for the deterioration sensing of the organic light-emitting diode OLED is completed.

The sampling period SAMPLING is a period for detecting the capacitance charged in the parasitic capacitor Coled after the parasitic capacitor Coled of the organic light-emitting diode OLED is charged.

The recovery period (it is not described in FIGs) is a period which may be further performed after the sampling period SAMPLING, and it may have a predetermined time duration between a time which the deterioration sensing for the organic light-emitting diode OLED is completed and a time which a display driving is restarted. It may be regarded as a period for resetting the voltage applied to each voltage line to drive the display device 100 after the deterioration sensing of the organic light-emitting diode OLED.

Figure 7:
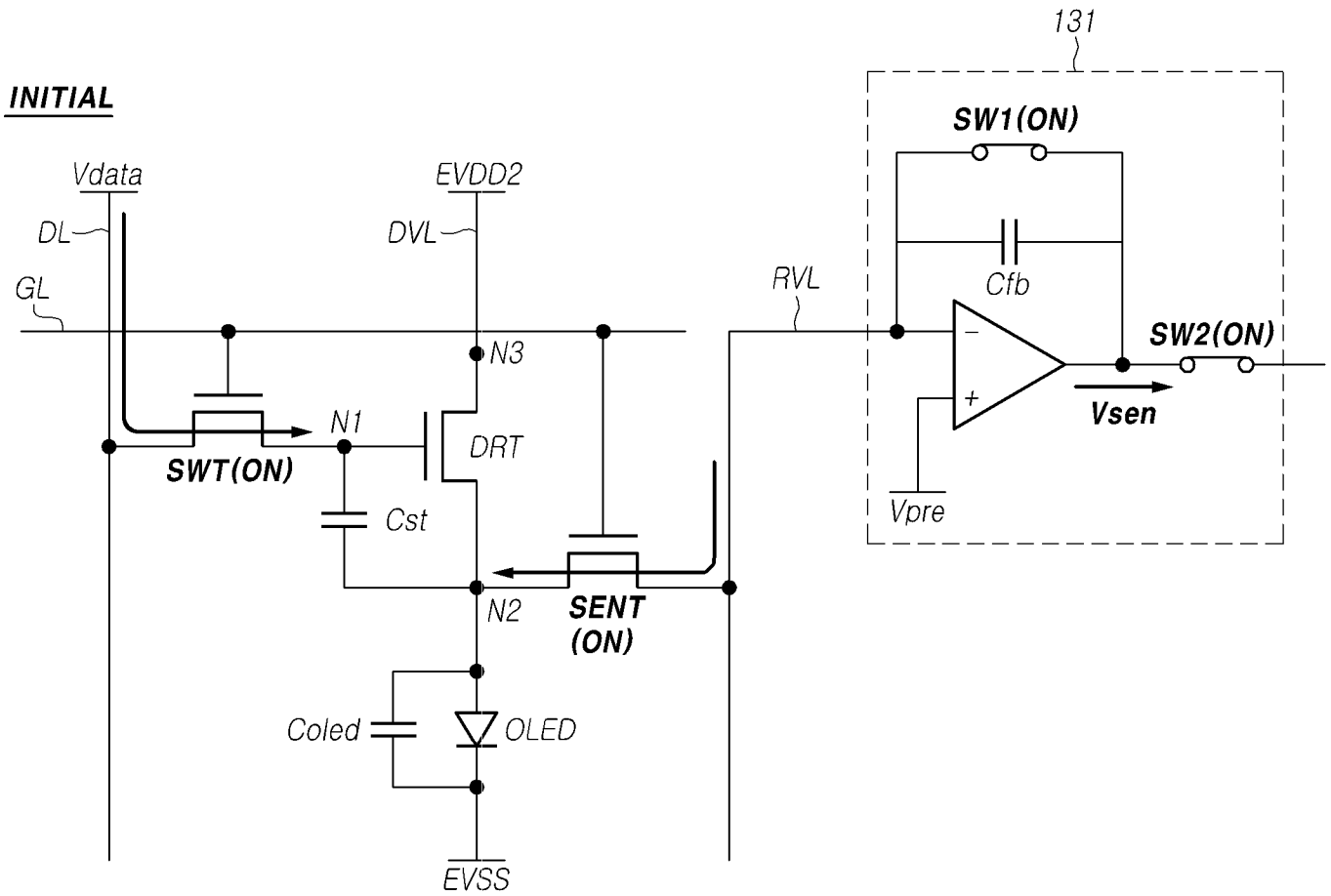
FIG. 7, FIG. 8 and FIG. 9 illustrate a diagram showing states of a subpixel for each initializing period, boosting period, and a sampling period in a deterioration sensing process of an organic light-emitting diode OLED.
Figure 8:
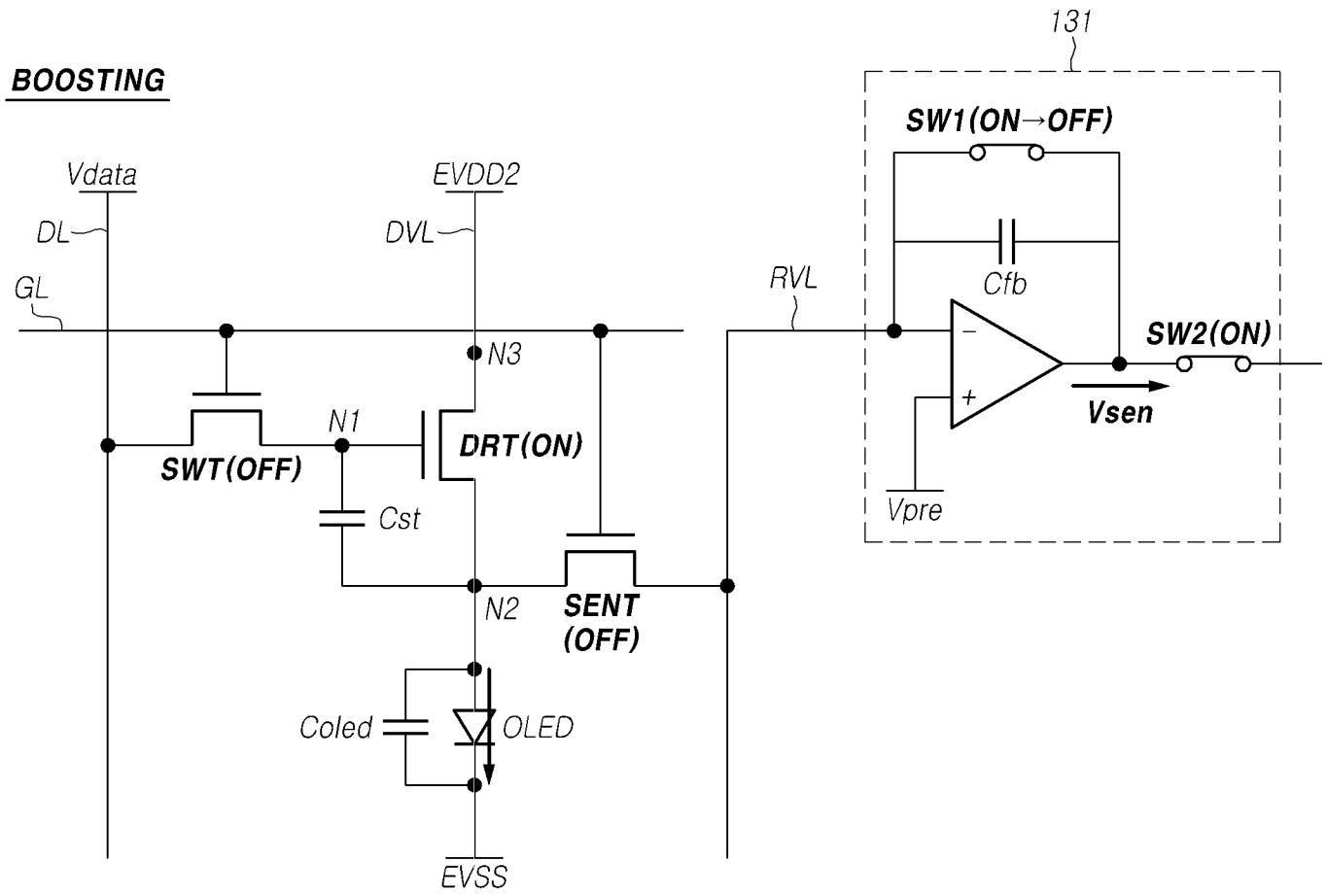
Figure 9:
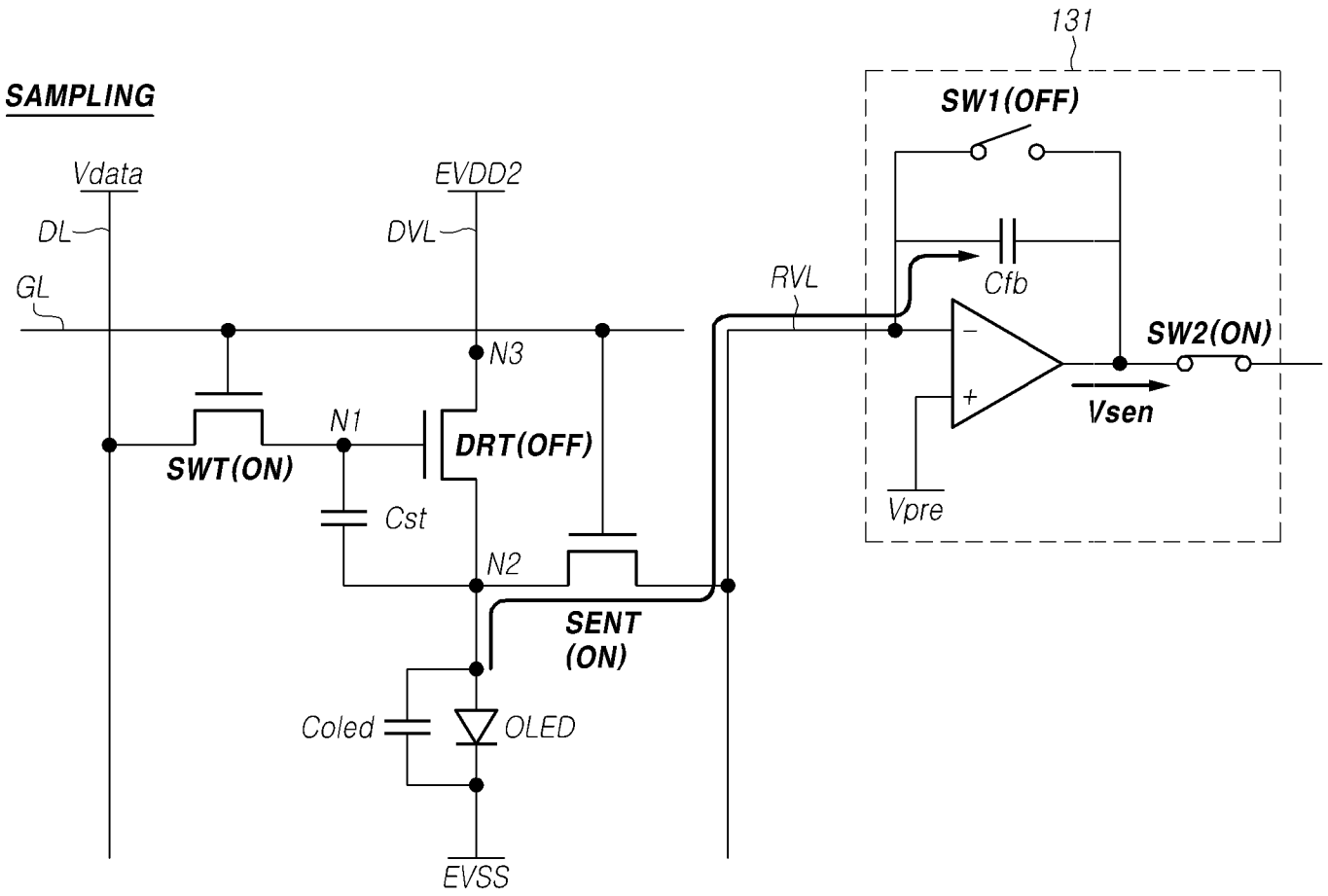

FIG. 7, FIG. 8, and FIG. 9 illustrate a diagram showing states of a subpixel for each initializing period INITIAL, boosting period BOOSTING, and a sampling period SAMPLING in a deterioration sensing process of an organic light-emitting diode OLED.

The deterioration sensing for the organic light-emitting diode OLED may be performed during a period separated from the image driving period. For example, the deterioration sensing may be performed before the display device 100 begins image driving by turning on or after a power switch is turned off. Alternatively, the deterioration sensing may be performed in the horizontal blank period or the vertical blank period, and the deterioration sensing may be performed in accordance with the input of the user.

At this time, the deterioration sensing for the organic light-emitting diode OLED may be performed in the deterioration sensing circuit 131 in the data driver circuit 130. Specifically, the data driver circuit 130 supplies the data voltage-for-sensing deterioration Vdata through the data line DL and supplies the reference voltage-for-sensing deterioration Vref through the reference voltage line RVL during the deterioration sensing period of the organic light-emitting diode OLED. As a result, since a voltage difference is formed between the first node N1 and the second node N2 of the driving transistor DRT, current may be supplied to the organic light-emitting diode OLED, and the parasitic capacitor Coled may be charged.

The driving voltage-for-sensing deterioration EVDD2 applied through the driving voltage line DVL during the deterioration sensing period of the organic light emitting diode OLED may be lower (for example, 10V) than the image driving voltage EVDD1 supplied by during the image driving period. Thus, the voltage of the anode of the organic light-emitting diode OLED may have a constant value regardless of deterioration of the organic light-emitting diode OLED. That is, in a state where the voltage of the anode of the organic light-emitting diode OLED is fixed, the degree of deterioration of the organic light-emitting diode OLED may be accurately sensed by measuring the change of the capacitance charged by the current flowing through the organic light-emitting diode OLED.

The deterioration sensing circuit 131 senses the capacitance charged in the parasitic capacitor Coled of the organic light-emitting diode OLED and outputs a sensing voltage Vsen according to the sensed capacitance. The sensing voltage Vsen may be transmitted to the timing controller 140 and the timing controller 140 may determine the degree of deterioration of the organic light-emitting diode OLED using the sensing voltage Vsen. By virtue of supplying a compensated data voltage Vdata_comp according to the degree of deterioration to the corresponding subpixel SP, the corresponding subpixel SP may display the luminance corresponding to the data voltage Vdata and non-uniformity in luminance caused by the deterioration may be prevented.

The deterioration sensing circuit 131 may have various structures. For example, the deterioration sensing circuit 131 may include a feedback capacitor Cfb and an operational amplifier serving as an amplifier. Also, it may include a reset switch SW1 for initializing the feedback capacitor Cfb and a sampling switch SW2 for sampling the sensing voltage Vsen.

The operational amplifier may receive the reference voltage-for-sensing Vpre at the non-inverting input terminal (+) and the inverting input terminal (−) may be connected to a reference voltage line RVL. A feedback capacitor Cfb may be electrically connected between the inverting input terminal (−) and the output terminal of the operational amplifier. Accordingly, the capacitance charged in the parasitic capacitor Coled of the organic light-emitting diode OLED is transmitted to the feedback capacitor Cfb, so that the capacitance change of the parasitic capacitor Coled of the organic light-emitting diode OLED according to deterioration of the organic light-emitting diode OLED may be sensed.

Since the operational amplifier has an output in the negative direction as the capacitance charged in the feedback capacitor Cfb increases, the sensing voltage Vsen increases when the capacitance charged in the parasitic capacitor Coled of the organic light-emitting diode OLED decreases due to deterioration of the organic light-emitting diode OLED.

During the initializing period INITIAL, a high level scan signal SCAN is applied to the gate line GL, and the reset switch SW1 and the sampling switch SW2 in the deterioration sensing circuit 131 are turned on.

Accordingly, the switching transistor SWT and the sensing transistor SENT are turned on. As the switching transistor SWT is turned on, the data voltage-for-sensing deterioration Vdata is supplied to the first node N1 of the driving transistor DRT and the data voltage-for-sensing deterioration Vdata may be, for example, about 15V. As the sensing transistor SENT is turned on, the reference voltage-for-sensing deterioration Vpre is supplied to the second node N2 of the driving transistor DRT and the reference voltage-for-sensing deterioration Vpre may be, for example, about 4V.

At this time, the driving voltage-for-sensing deterioration EVDD2 supplied to the driving voltage line DVL may be lower (for example, 10v) than the image driving voltage EVDD1 (for example, about 27V) supplied during the image driving period. The reason why the level of the driving voltage-for-sensing deterioration EVDD2 supplied during the deterioration sensing period of the organic light-emitting diode OLED is set to be lower than the image driving voltage EVDD1 supplied during the image driving period is that the capacitance charged in the parasitic capacitor Coled of the organic light-emitting diode OLED may be accurately sensed by maintaining the voltage level at second node N2 of the driving transistor DRT.

At this time, the reset switch SW1 of the deterioration sensing circuit 131 may be maintained in the turn-on state to reset the feedback capacitor Cfb. By resetting the feedback capacitor Cfb, the operational amplifier in the deterioration sensing circuit 131 is also reset, and the reset time of the operational amplifier may be determined according to the capacity and characteristics of the feedback capacitor Cfb.

During the boosting period BOOSTING, a low level scan signal SCAN is supplied to the gate line GL. The reset switch SW1 and the sampling switch SW2 of the deterioration sensing circuit 131 maintain the turn-on state and the reset switch SW1 may be turned off before the sampling period SAMPLING begins.

As the low level scan signal SCAN is supplied to the gate line GL during the boosting period BOOSTING, the switching transistor SWT and the sensing transistor SENT are turned off. Accordingly, the first node N1 and the second node N2 of the driving transistor DRT are in a floating state, and the voltages of the first node N1 and the second node N2 gradually increase. As a result, a current flows to the organic light-emitting diode OLED, and the parasitic capacitor Coled of the organic light-emitting diode OLED is charged.

At this time, since the level of the driving voltage-for-sensing deterioration EVDD2 supplied during the boosting period BOOSTING is lower than the level of the image driving voltage EVDD1, the voltage at the second node N2 of the driving transistor DRT as an operating voltage of the organic light-emitting diode OLED maintains a constant level regardless of deterioration of the organic light-emitting diode OLED. As a result, the parasitic capacitor Coled of the organic light-emitting diode OLED may be charged with the constant voltage of the anode N2 of the organic light-emitting diode OLED.

Since the capacitance charged in the parasitic capacitor Coled may decrease as the deterioration progresses, deterioration of the organic light-emitting diode OLED may be sensed by detecting change of the capacitance charged in the parasitic capacitor Coled.

During the sampling period SAMPLING, the switching transistor SWT and the sensing transistor SENT are turned on by a high level scan signal SCAN applied to the gate line GL. A data voltage Vdata is supplied to the data line DL at a level, for example, a voltage of about 0.5V, capable of turning off the driving transistor DRT. At this time, the reset switch SW1 of the deterioration sensing circuit 131 maintains the turn-off state, and the sampling switch SW2 maintains the turn-on state.

Since the driving transistor DRT is in the turn-off state and the reset switch SW1 of the deterioration sensing circuit 131 is in the turn-off state, the feedback capacitor Cfb of the deterioration sensing circuit 131 is charged according to the capacitance charged in the parasitic capacitor Coled of the organic light-emitting diode OLED through the reference voltage line RVL.

The operational amplifier of the deterioration sensing circuit 131 outputs a sensing voltage Vsen according to the capacitance charged in the feedback capacitor Cfb, and the larger the capacitance charged in the feedback capacitor Cfb is, the more the sensing voltage Vsen is directed to the negative (−) direction. Therefore, if the capacitance charged in the parasitic capacitor Coled decreases due to deterioration of the organic light-emitting diode OLED, the capacitance charged in the feedback capacitor Cfb decreases, and as a result, the sensing voltage Vsen of the operational amplifier is increased rather than before deterioration. The deterioration of the organic light-emitting diode OLED may be sensed by using the sensing voltage Vsen thus outputted from the operational amplifier.

After the deterioration sensing period is finished, a recovery period for resetting the voltage applied to each voltage line may be further progressed for next image driving period.

In this case, the deterioration sensing period for the organic light-emitting diode OLED may be progressed after the display panel 110 powers on and before the image driving begins. These sensing and sensing process are referred to as on-sensing and on-sensing process. Alternatively, it may be progressed after a power switch of the display panel 110 is turned off. Such sensing and sensing process are referred to as off-sensing and off-sensing process.

Alternatively, the deterioration sensing period may be progressed in real time during the image driving. This sensing process is referred to as a real-time sensing (RT sensing) process. In the case of the RT sensing process, the deterioration sensing period may be progressed for one or more subpixels SP in one or more subpixel SP lines during each blank period in the image driving period.

When the deterioration sensing process is performed at the blank period, the subpixel SP line where the deterioration sensing process is performed may be selected at random. Thus, the image error appeared in the image driving period may be reduced after the deterioration sensing process has performed during the blank period. In addition, a compensated data voltage may be supplied to the subpixel SP, in which the deterioration sensing process is performed in the image driving period, after the deterioration sensing process is performed during the blank period. Accordingly, the image error appeared in the subpixel SP line which is completed the deterioration sensing process may be further reduced after the deterioration sensing process in the blank period.

Figure 10:
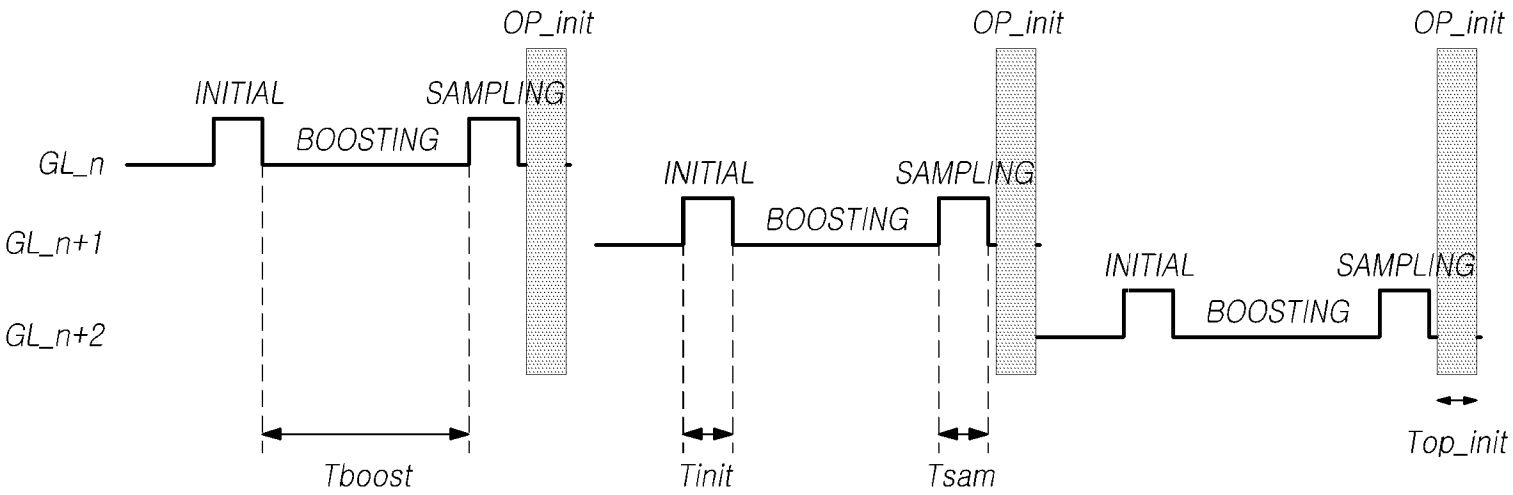
FIG. 10 illustrates a signal timing diagram for sensing deterioration of an organic light-emitting diode by gate line in the conventional display device.

FIG. 10 illustrates a signal timing diagram for sensing deterioration of an organic light-emitting diode by gate line in the conventional display device.

Referring to FIG. 10, the conventional display device proceeds the deterioration sensing process for another subpixel SP belonging to another gate ling GL after an initializing period INITIAL, a boosting period BOOSTING, and a sampling period SAMPLING for an organic light-emitting diode OLED in a subpixel SP belonging to a specific gate line GL are all completed.

For example, the deterioration sensing process for the organic light-emitting diode OLED with respect to a subpixel SP of a gate line GL may be at first performed by sensing the deterioration for the organic light-emitting diode OLED with respect to a subpixel SP selected in a nth gate line GL_n. In other words, for a subpixel SP selected in the nth gate line GL_n, a deterioration sensing voltage Vsen is measured by supplying sequentially a scan signal SCAN and a sense signal SENSE to the organic light-emitting diode OLED during an initializing period INITIAL, a boosting period BOOSTING, and a sampling period SAMPLING for sensing the deterioration of the organic light-emitting diode OLED, and by sensing the current flowing on the organic light-emitting diode OLED through the deterioration sensing circuit 131. Thereafter, the feedback capacitor Cfb and the operational amplifier are reset by turning on the reset switch SW1 of the deterioration sensing circuit 131, and then the deterioration sensing process for the (n+1)th gate line GL_n+1 is performed.

After the deterioration sensing process for the organic light-emitting diode OLED with respect to the nth gate line GL_n is completed, deterioration sensing process including an initializing period INITIAL, a boosting period BOOSTING, and a sampling period SAMPLING is repeatedly progressed for the subpixel SP selected in the n+1th gate line GL_n+1. That is, after the deterioration sensing process for the organic light-emitting diode OLED in a specific gate line GL is completed, the deterioration sensing process for the other gate line GL is progressed in a sequential manner.

Accordingly, the time required for the deterioration sensing of the organic light-emitting diode OLED with respect to a gate line GL is determined by a sum of a initializing time Tinit corresponding to the initializing period INITIAL, a boosting time Tboost corresponding to the boosting period BOOSTING, and a sampling time Tsam corresponding to the sampling period SAMPLING. In addition, an operational amplifier reset time Top_init of the deterioration sensing circuit 131 is further required for the deterioration sensing process for the next gate line GL.

This increases the time required to sense the deterioration of the organic light-emitting diode OLED with respect to the entire gate line GL constituting the display panel 110, and gives rise to a problem that a compensation time and image driving time are delayed.

According to the present disclosure, the deterioration sensing processes of the organic light-emitting diodes OLEDs are progressed in parallel through gate lines GLs to save the total deterioration sensing time for the display panel 110, and to improve the efficiency of the compensation process and the operation speed of the display apparatus 100.

In order to accurately sense the deterioration of the organic light-emitting diode OLED, it is beneficial to check the time duration used in detailed deterioration sensing process. Particularly, as the time to use the organic light-emitting diode OLED increases, the lifetime is reduced and the degree of deterioration is increased. For example, as the remaining lifetime of the organic light-emitting diode OLED is reduced, variation of distribution with respect to the deterioration sensing value increases, and as a result, compensation value according to a deterioration sensing process becomes unstable. Therefore, it is effective to maintain a boosting period BOOSTING and a sampling period SAMPLING for predetermined time durations or more. For example, it may be beneficial to secure time duration for the boosting period BOOSTING as several hundreds of microseconds or more and time duration for the sampling period SAMPLING as several tens of microseconds or more.

On the other hand, in an initializing period INITIAL, a voltage for sensing deterioration may be charged by applying the scan signal SCAN through the gate line GL. Therefore, since the initializing period INITIAL may be shorter than the boosting period BOOSTING, and it may be similar to or less than the sampling period SAMPLING, the time duration used for the initializing period INITIAL may be determined at similar or shorter than the time duration of the sampling period SAMPLING.

According to the present disclosure, a deterioration sensing time of the display panel 110 may be saved by supplying the scan signal SCAN and the sense signal SENSE in parallel to a plurality of gate lines GLs while maintaining a boosting period BOOSTING and a sampling period SAMPLING used for sensing deterioration of the organic light-emitting diode OLED in a subpixel SP.

Figure 11:
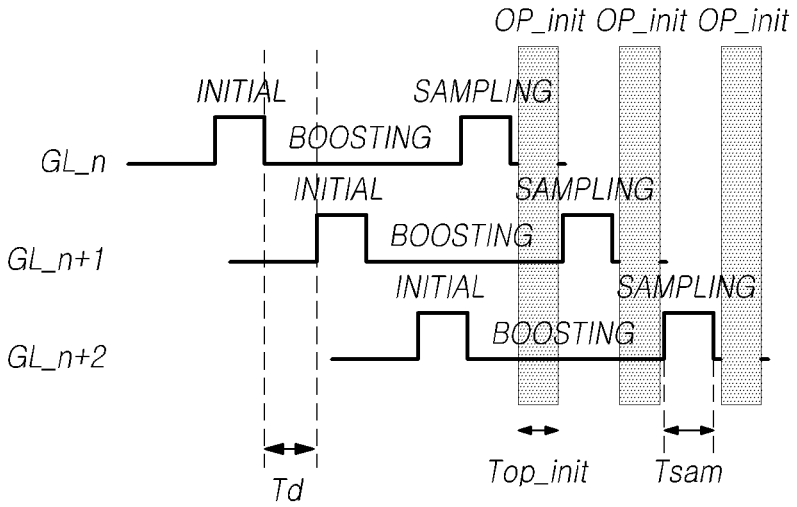
FIG. 11 illustrates a signal timing diagram for sensing deterioration of an organic light-emitting diode by gate line in the display device according to one or more embodiments.

FIG. 11 illustrates a signal timing diagram for sensing deterioration of an organic light-emitting diode by gate line in the display device according to one or more embodiments.

Referring to FIG. 11, in the display device 100 according to one or more embodiments, a plurality of deterioration sensing processes may be progressed in parallel (with a superimposed manner) by performing an initializing period INITIAL for the other gate line GL within a boosting period BOOSTING, because a boosting period BOOSTING is relatively longer than an initializing period INITIAL and a sampling period SAMPLING among a deterioration sensing period for the organic light-emitting diode OLED. For example, according to some embodiments, the deterioration sensing process for each gate line can be performed in an overlapping, non-sequential manner.

Particularly, since a switching transistor SWT and a sensing transistor SENT of a subpixel SP in a deterioration sensing process are turned-off state in a boosting period BOOSTING, another initializing period INITIAL for sensing deterioration with respect to another gate line GL may be progressed within the boosting period BOOSTING.

An initializing period INITIAL, a boosting period BOOSTING, and a sampling period SAMPLING for sensing deterioration for an organic light-emitting diode OLED in a specific subpixel SP with respect to nth gate line GL_n are progressed. When a deterioration sensing voltage Vsen for an organic light-emitting diode OLED is determined by a deterioration sensing circuit 131, the operational amplifier of the deterioration sensing circuit 131 is reset by turning on the reset switch SW1. At this time, the reset period of the operational amplifier OP_init in the deterioration sensing circuit 131 may be progressed during a reset time of the operational amplifier Top_init required to discharge the capacitance charged in the feedback capacitor Cfb.

When a certain delay time Td passes after the initializing period INITIAL for a specific subpixel SP through nth gate line GL_n, another initializing period INITIAL for deterioration sensing with respect to (n+1)th gate line GL_n+1 is progressed. In other words, the deterioration sensing process for the (n+1)th gate line GL_n+1 is progressed after a certain delay time Td has passed from a start time of the deterioration sensing process for the nth gate line GL_n. At this time, the delay time Td of the deterioration sensing process may correspond to one horizontal period 1H of a display device 100, or may correspond to another time interval.

When a boosting period BOOSTING for deterioration sensing of the organic light-emitting diode OLED has a time duration, for example several hundreds of microseconds, the deterioration sensing process for (n+1)th gate line GL_n+1 and other gate lines GLs may be progressed in parallel with a certain delay time Td after the deterioration sensing process for nth gate line GL_n.

A number of the gate lines GLs in which deterioration sensing process may be progressed in parallel will be a value obtained by dividing the boosting period BOOSTING by the reset time of operational amplifier Top_init. That is, if a boosting period BOOSTING is A μs and a reset time of operational amplifier Top_init is B μs, the deterioration sensing processes may be progressed from the nth gate line GL_n to the n+(A/B)th gate line GL_n+(A/B) with a delay time Td of B μs after the deterioration sensing process for the nth gate line GL_n begins.

When the sampling period SAMPLING according to the deterioration sensing of the subpixel SP is completed through the nth gate line GL_n, a reset period of operational amplifier OP_init in the deterioration sensing circuit 131 is progressed. At this time, since the initializing period INITIAL and the boosting period BOOSTING for deterioration sensing process have already been progressed in the (n+1)th gate line GL_n+1, the deterioration sensing circuit 131 may progress immediately the sampling period SAMPLING with respect to the (n+1)th gate line GL_n+1.

If a sampling time Tsam which is time interval of the sampling period SAMPLING, is maintained, for example at several tens of microseconds, another reset period of operational amplifier OP_init in the deterioration sensing circuit 131 with respect to (n+1)th gate line GL_n+1 may be progressed again after several tens of microseconds passes from the time when a reset period of operational amplifier OP_init in the deterioration sensing circuit 131 is completed through the deterioration sensing process in the nth gate line GL_n.

Accordingly, after the initializing period INITIAL, the boosting period BOOSTING, and the sampling period SAMPLING with respect to the nth gate line GL_n for a first deterioration sensing process of an organic light-emitting diode OLED are sequentially progressed, a sampling period SAMPLING and a reset period of operational amplifier OP_init will be repeatedly progressed with a sampling time Tsam corresponding to a sampling period SAMPLING.

As described above, it is possible to save a sensing time for an entire display panel 110 and improve a driving speed of the display device 100 by progressing deterioration sensing processes with respect to another gate lines GLs in parallel during a deterioration sensing period, particularly during a boosting period BOOSTING, with respect to a gate line GL.

At this time, the gate driver circuit 120 for supplying the scan signal SCAN/sense signal SENSE to a subpixel SP through a gate line GL is controlled by a timing controller 140. Accordingly, in order to progress the deterioration sensing processes of the organic light-emitting diodes OLEDs in parallel with respect to the plurality of gate lines GLs, it is effective for the gate driver circuit 120 to supply the scan signal SCAN/sense signal SENSE at the delay time Td defined by the timing controller 140. Of course, it is also possible to further include a circuit with a module form capable of controlling the scan signal SCAN/sense signal SENSE inside the gate driver circuit 120.

At the above descriptions, the switching transistor SWT and the sensing transistor SENT are turned on and turned off simultaneously by a scan signal SCAN from a single gate line GL connected to the switching transistor SWT and the sensing transistor SENT together. However, it is also possible that the display device 100 has a separation structure in which a scan signal SCAN is applied to the gate node of the switching transistor SWT and a sense signal SENSE is applied to the gate node of the sensing transistor SENT as described above.

The foregoing descriptions and the accompanying drawings have been presented in order to explain certain principles of the present disclosure by way of example. A person having ordinary skill in the art related to the present disclosure could make various modifications and variations without departing from the principle of the present disclosure. The foregoing embodiments disclosed herein shall be interpreted as being illustrative, while not being limitative, of the principle and scope of the present disclosure.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including a plurality of gate lines, a plurality of data lines, and a plurality of subpixels formed adjacent to overlapping locations of the gate lines and the data lines;

a gate driver circuit for driving the plurality of gate lines;

a data driver circuit for driving the plurality of data lines;

a deterioration sensing circuit electrically connected to the plurality of the subpixels for sensing deterioration of a first organic light-emitting diode in a first subpixel of the plurality of subpixels and a second organic light-emitting diode in a second subpixel of the plurality of subpixels, wherein the first organic light-emitting diode is connected to a first gate line of the plurality of gate lines and the second organic light-emitting diode is connected to a second gate line of the plurality of gate lines; and a timing controller for controlling signals applied to the gate driver circuit and the data driver circuit, wherein the timing controller controls the gate driver circuit to progress a first deterioration sensing process including an initializing period, a boosting period, and a sampling period with respect to the first organic light-emitting diode in the first subpixel connected to the first gate line, and to begin another initializing period of a second deterioration sensing process during the boosting period of the first deterioration sensing process with respect to the second organic light-emitting diode in the second subpixel connected to a second gate line.

2. The display device according to claim 1, wherein the subpixel of the plurality of subpixels comprises:

an organic light-emitting diode;

a driving transistor driving the organic light-emitting diode and receiving a driving voltage-for-sensing deterioration, the driving transistor including a source node, a gate node, and a drain node;

a switching transistor electrically connected between the gate node of the driving transistor and a data line among the plurality of data lines; and a sensing transistor electrically connected between either the source node or the drain node of the driving transistor and a reference voltage line.

3. The display device according to claim 1, wherein the deterioration sensing circuit comprises:

an amplifier in which a non-inverting input terminal receives a reference voltage-for-sensing and an inverting input terminal is connected to a reference voltage line;

a feedback capacitor electrically connected between the inverting input terminal and an output terminal of the amplifier;

a reset switch connected to the feedback capacitor in parallel; and a sampling switch connected to the output terminal of the amplifier.

4. The display device according to claim 1, wherein the deterioration sensing process with respect to the first organic light-emitting diode comprises:

an initializing period in which a high level scan signal is supplied to the first gate line to charge a voltage for the deterioration sensing the first organic light-emitting diode;

a boosting period in which a parasitic capacitor of the first organic light-emitting diode is charged by a current flowing through the first organic light-emitting diode after the voltage charging for the deterioration sensing of the first organic light-emitting diode is completed; and a sampling period in which a capacitance charged in the parasitic capacitor of the first organic light-emitting diode is detected.

5. The display device according to claim 4, wherein the deterioration sensing process with respect to the first organic light-emitting diode further comprises a reset period for resetting the deterioration sensing circuit after the sampling period.

6. The display device according to claim 5, wherein a time interval between the first deterioration sensing process and the second deterioration sensing process is larger than a time duration of the reset period of the deterioration sensing circuit.

7. A method of sensing a characteristic value of a circuit element in a display device comprising:

charging a voltage of a first organic light-emitting diode connected to a first gate line at a first initializing period;

charging a parasitic capacitor connected parallel to the first organic light-emitting diode at a first boosting period, wherein the first boosting period starts after the first initializing period;

detecting a parasitic capacitance of the parasitic capacitor at a first sampling period after the first boosting period; and charging a voltage of a second organic light-emitting diode connected to a second gate line at a second initializing period during the first boosting period of the first organic light-emitting diode.

8. The method according to claim 7, further comprising:

forming a subpixel, wherein forming the subpixel includes:

forming an organic light-emitting diode;

forming a driving transistor driving the organic light-emitting diode that is configured to receive a driving voltage-for-sensing deterioration;

forming a switching transistor electrically connected between a gate node of the driving transistor and a data line among a plurality of data lines; and forming a sensing transistor electrically connected between a source node or a drain node of the driving transistor and a reference voltage line.

9. The method according to claim 8, further comprising:

forming a deterioration sensing circuit, wherein forming the deterioration sensing circuit includes:

forming an amplifier in which a non-inverting input terminal receives a reference voltage-for-sensing and an inverting input terminal is connected to a reference voltage line;

forming a feedback capacitor electrically connected between the inverting input terminal and an output terminal of the amplifier;

forming a reset switch connected to the feedback capacitor in parallel; and forming a sampling switch connected to the output terminal of the amplifier.

10. The method according to claim 9, further comprising:

resetting the deterioration sensing circuit after the sampling period during a reset period.

11. The method according to claim 10, wherein a time interval between the first initializing period and the second initializing period is larger than a time duration of the reset period of the deterioration sensing circuit.

12. The method according to claim 7, wherein charging a voltage of a first organic light-emitting diode connected to a first gate line at a first initializing period includes:

supplying a high level scan signal to the first gate line to charge a voltage for the first organic light-emitting diode.

13. The method according to claim 7, wherein charging a parasitic capacitor connected parallel to the first organic light-emitting diode at a first boosting period includes:

charging the parasitic capacitor of the first organic light-emitting diode by a current flowing through the first organic light-emitting diode after the voltage charging for the first organic light-emitting diode is completed.

14. The method according to claim 7, wherein detecting a parasitic capacitance of the parasitic capacitor at a first sampling period after the first boosting period includes:

detecting the parasitic capacitance charged in the parasitic capacitor of the first organic light-emitting diode.

* * * * *